US011189201B2

(12) United States Patent
Moradi et al.

(10) Patent No.: US 11,189,201 B2
(45) Date of Patent: Nov. 30, 2021

(54) DISPLAY, PIXEL CIRCUIT, AND METHOD

(71) Applicant: Ignis Innovation Inc., Waterloo (CA)

(72) Inventors: Arash Moradi, Toronto (CA); Jafar Talebzadeh, Waterloo (CA); Junhu He, Waterloo (CA); Shuenn-Jiun Tang, Guelph (CA)

(73) Assignee: Ignis Innovation Inc., Waterloo (CA)

( * ) Notice: Subject to any disclaimer, the term of this patent is extended or adjusted under 35 U.S.C. 154(b) by 1 day.

(21) Appl. No.: 16/198,833

(22) Filed: Nov. 22, 2018

(65) Prior Publication Data

US 2019/0156717 A1 May 23, 2019

Related U.S. Application Data

(60) Provisional application No. 62/590,060, filed on Nov. 22, 2017.

(51) Int. Cl.

| | |
|---|---|
| ***G09G 3/00*** | (2006.01) |
| ***G09G 3/3225*** | (2016.01) |
| ***G09G 3/3233*** | (2016.01) |

(52) U.S. Cl.

CPC ..... *G09G 3/006* (2013.01); *G09G 3/3225* (2013.01); *G09G 3/3233* (2013.01); *G09G 2300/0861* (2013.01); *G09G 2310/0251* (2013.01); *G09G 2310/0262* (2013.01); *G09G 2320/0295* (2013.01); *G09G 2320/043* (2013.01); *G09G 2320/0693* (2013.01); *G09G 2330/12* (2013.01)

(58) Field of Classification Search

USPC ..... 345/204

See application file for complete search history.

(56) References Cited

U.S. PATENT DOCUMENTS

| | | | | |
|---|---|---|---|---|
| 2014/0035799 | A1* | 2/2014 | Bae | G09G 3/3266 345/82 |
| 2016/0055791 | A1* | 2/2016 | Kishi | G09G 3/3241 345/212 |
| 2016/0078825 | A1* | 3/2016 | Kim | G09G 3/3607 345/89 |
| 2016/0140902 | A1* | 5/2016 | Yang | G09G 3/3258 345/78 |
| 2016/0148566 | A1* | 5/2016 | Tseng | G09G 3/3233 345/212 |
| 2016/0163261 | A1* | 6/2016 | Kim | G09G 3/3233 345/205 |

* cited by examiner

*Primary Examiner* — Nelson M Rosario
(74) *Attorney, Agent, or Firm* — Stratford Group Ltd.

(57) ABSTRACT

Active Matrix Organic Light Emitting Diode (AMOLED) displays, novel pixel circuits therefor, and methods of programming the pixel circuit and measuring the current of the pixel circuit and OLED thereof are disclosed. One pixel circuit includes four TFT transistors, a storage capacitor and an OLED device and is programmed with use of voltage supplied through a data line. One method measures currents of the OLED and the pixel circuit through the data line by a readout circuit.

22 Claims, 11 Drawing Sheets

DISPLAY, PIXEL CIRCUIT, AND METHOD

CROSS-REFERENCE TO RELATED APPLICATION

This application claims the benefit of U.S. Provisional Application No. 62/590,060, filed Nov. 22, 2017, which is hereby incorporated by reference herein in its entirety.

FIELD OF THE PRESENT DISCLOSURE

The present disclosure relates to active matrix organic light emitting diode (AMOLED) displays and particularly to pixel circuits thereof and methods of driving and measuring pixel and organic light emitting diode (OLED) currents in order to extract pixel and OLED parameters.

BRIEF SUMMARY

According to a first aspect there is provided a display system comprising: an array of pixel circuits arranged in rows and columns, a pixel circuit of the array of pixel circuits including: a drive transistor including a source terminal coupleable to a data line of the display system; a storage capacitor coupled across a gate terminal and the source terminal of the drive transistor; and a light emitting device coupleable to a drain terminal of the drive transistor different from the source terminal, and a controller for driving the pixel circuit in a plurality of operation states for the pixel circuit including a programming state for programming the storage capacitor of the pixel circuit with use of a data voltage provided over the data line, and a measurement state for measuring a current from the pixel circuit over the data line.

In some embodiments, the display system further comprises a readout circuit coupleable to the data line for measuring the current from the pixel circuit over the data line.

In some embodiments, the readout circuit comprises an integrator for integrating said current from the pixel during said measuring and generating an output voltage corresponding to said integrated current, and an analog to digital converter for converting said output voltage into a digital code output.

In some embodiments, the readout circuit is not coupleable to the pixel circuit via a signal line different from the data line for measuring the current from the pixel circuit.

In some embodiments, the measurement state for measuring a current from the pixel circuit comprises an organic light emitting diode (OLED) measurement state for measuring an OLED current from the pixel circuit passing through said light emitting device.

In some embodiments, the pixel circuit further comprises a reference line coupleable to a gate terminal of the drive transistor, and in which the controller, during the OLED measurement state, couples the gate terminal of the drive transistor to the reference line and provides a reference voltage over the reference line sufficient to turn on the drive transistor such that it acts as a closed switch, couples the source terminal of the drive transistor to the data line and provides a data voltage over the data line sufficient to turn on the light emitting device.

In some embodiments, the display system further comprises a readout circuit coupleable to the data line for measuring the current from the pixel circuit over the data line, the readout circuit comprising an integrator for integrating said OLED current from the pixel during said measuring and generating a corresponding output voltage, and an analog to digital converter for converting said output voltage into a digital code output, in which the controller couples the gate terminal of the drive transistor to the reference line with use of a first transistor in the pixel circuit, and couples the source terminal of the drive transistor to the data line with use of a second transistor coupled between the source terminal and the data line.

In some embodiments, the measurement state for measuring a current from the pixel circuit comprises a pixel circuit measurement state for measuring a pixel circuit current from the pixel circuit passing through said drive transistor according to the voltage difference across the storage capacitor, said pixel circuit measurement state subsequent to the programming state.

In some embodiments, the pixel circuit further comprises a reference line coupleable to a gate terminal of the drive transistor, in which the controller, during the pixel circuit measurement state, decouples the reference line from the gate terminal of the drive transistor to maintain the voltage difference across the storage capacitor, and couples the source terminal of the drive transistor to the data line.

In some embodiments, the display system further comprises a readout circuit coupleable to the data line for measuring the current from the pixel circuit over the data line, the readout circuit comprising an integrator for integrating said pixel circuit current from the pixel circuit during said measuring and generating a corresponding output voltage and an analog to digital converter for converting said output voltage into a digital code output, and in which the controller during the pixel circuit measurement state, decouples the reference line from the gate terminal with use of a first transistor coupled between the gate terminal of the drive transistor and the reference line, and couples the source terminal of the drive transistor to the data line with use of a second transistor coupled between the source terminal and the data line.

In some embodiments, the pixel circuit comprises transistors which are only p-type thin film transistors (TFTs), and in which said light emitting device is an OLED.

According to a second aspect there is provided a method of driving a display system, the display system including an array of pixel circuits arranged in rows and columns, a pixel circuit of the array of pixel circuits including: a drive transistor including a source terminal coupleable to a data line of the display system; a storage capacitor coupled across a gate terminal and the source terminal of the drive transistor; and a light emitting device coupleable to a drain terminal of the drive transistor different from the source terminal, the method comprising: driving the pixel circuit in a plurality of operation states for the pixel circuit including: programming the storage capacitor of the pixel circuit with use of a data voltage provided over the data line during a programming state, and measuring a current from the pixel circuit over the data line during a measurement state.

In some embodiments, measuring the current from the pixel circuit comprises coupling a readout circuit to the data line and measuring said current from the pixel circuit with use of said readout circuit.

In some embodiments, measuring said current from the pixel circuit with use of said readout circuit comprises integrating said current from the pixel circuit, generating a corresponding output voltage, and converting said output voltage into a digital code output.

In some embodiments, measuring the current from the pixel circuit comprises measuring an OLED current from the pixel circuit passing through said light emitting device during an OLED measurement state.

In some embodiments, the pixel circuit further comprises a reference line coupleable to a gate terminal of the drive transistor, and in which measuring the OLED current during the OLED measurement state comprises, coupling the gate terminal of the drive transistor to the reference line, providing a reference voltage over the reference line sufficient to turn on the drive transistor such that it acts as a closed switch, coupling the source terminal of the drive transistor to the data line, and providing a data voltage over the data line sufficient to turn on the light emitting device.

In some embodiments, measuring the OLED current during the OLED measurement state comprises: coupling the gate terminal of the drive transistor to the reference line with use of a first transistor in the pixel circuit; coupling the source terminal of the drive transistor to the data line with use of a second transistor coupled between the source terminal and the data line; and coupling a readout circuit to the data line and measuring said current from the pixel circuit with use of said readout circuit, including, integrating said OLED current from the pixel circuit, generating an output voltage corresponding to the integrated current, and converting said output voltage into a digital code output.

In some embodiments, measuring said current from the pixel circuit comprises measuring a pixel circuit current from the pixel circuit passing through said drive transistor according to the voltage difference across the storage capacitor, during a pixel circuit measurement state subsequent to the programming state.

In some embodiments, measuring the pixel current during the pixel circuit measurement state comprises decoupling the reference line from the gate terminal of the drive transistor to maintain the voltage difference across the storage capacitor and coupling the source terminal of the drive transistor to the data line.

In some embodiments, measuring the pixel circuit current during the pixel circuit measurement state comprises: decoupling a reference line from the gate terminal of the drive transistor with use of a first transistor coupled between the gate terminal of the drive transistor and the reference line; coupling the source terminal of the drive transistor to the data line with use of a second transistor coupled between the source terminal and the data line; and coupling a readout circuit to the data line and measuring said current from the pixel circuit with use of said readout circuit, including, integrating said pixel circuit current from the pixel circuit, generating an output voltage corresponding to the integrated current, and converting said output voltage into a digital code output.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
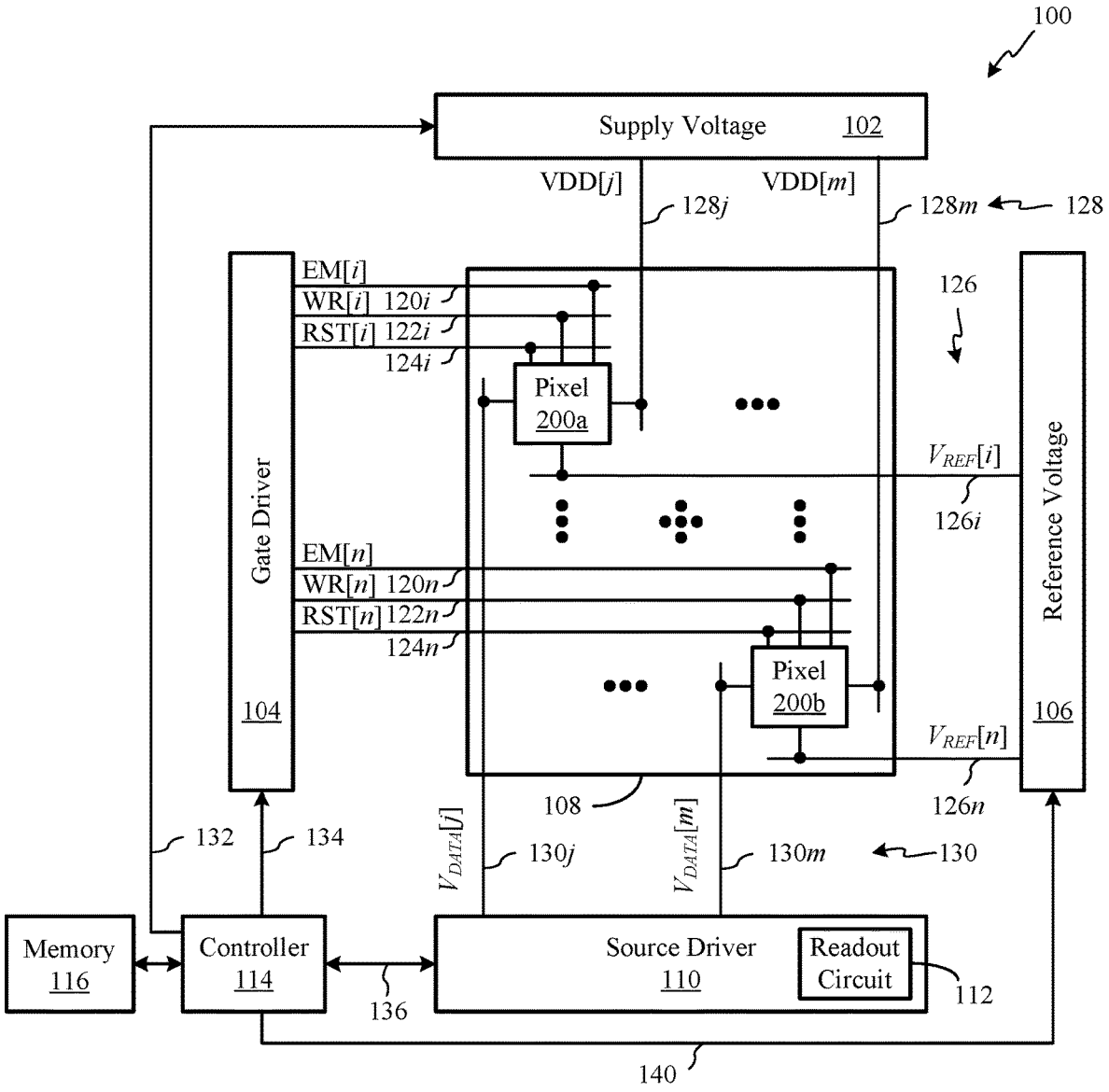
FIG. 1 is a schematic block diagram of an example active matrix display system in accordance with an embodiment.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

An OLED device is a Light Emitting Diode (LED) in which the emissive electroluminescent layer is a film of organic compound that emits light in response to an electric current. This layer of organic material is situated between two electrodes; typically, at least one of these electrodes is transparent. Compared to conventional Liquid Crystal Displays (LCDs), Active Matrix Organic Light Emitting Device (AMOLED) displays offer lower power consumption, manufacturing flexibility, faster response time, larger viewing angles, higher contrast, lighter weight, and amenability to flexible substrates. An AMOLED display works without a backlight because the organic material of the OLED within each pixel itself emits visible light and each pixel consists of different colored OLEDs emitting light independently. The OLED panel can display deep black level and can be thinner than an LCD display. The OLEDs emit light according to currents passing through them supplied through drive transistors controlled by programming voltages. The power consumed in each pixel has a relation with the magnitude of the generated light in that pixel.

The quality of output in an OLED-based pixel depends on the properties of the drive transistor, which is typically fabricated from materials including but not limited to amorphous silicon, polysilicon, or metal oxide, as well as properties of the OLED itself. In particular, the critical drawbacks of OLED displays include luminance non-uniformity due to the electrical characteristic variations of the drive transistor such as threshold voltage and mobility as the pixel ages and image sticking due to the differential aging of OLED devices. In order to maintain high image quality, variation of these parameters must be compensated for by adjusting the programming voltage. In order to do so, those parameters are extracted from the driver circuit. The measured information can then be used to inform subsequent programming of the pixel circuits so that adjustments may be made to the programming taking into account the measured degradation.

Aspects of the present disclosure include a novel pixel circuit in display panels and methods to drive and measure the pixel and OLED current in order to extract parameters of the pixel. The pixel circuit includes a Light-Emitting Device (LED), such as an Organic Light Emitting Diode (OLED), a storage capacitor and Thin Film Transistors (TFTs). Some methods include supplying voltage or current to the pixel circuit from the source via the data line and measuring an electric current in the data line. Some methods further include converting the measured current to voltage for further processing. For example, a source driver having a ReadOut Circuit (ROC) may be utilized for measuring a current from the pixel circuit. In some embodiments, the current from the pixel circuit can be either the current of the driving TFT or the current of the OLED. The current is converted into a corresponding voltage and then an Analog-to-Digital Convertor (ADC) is used to convert the voltage to a digital code, i.e. a 10 to 16 bit digital code. The digital code is provided to a digital processor for further processing.

Figure 2:
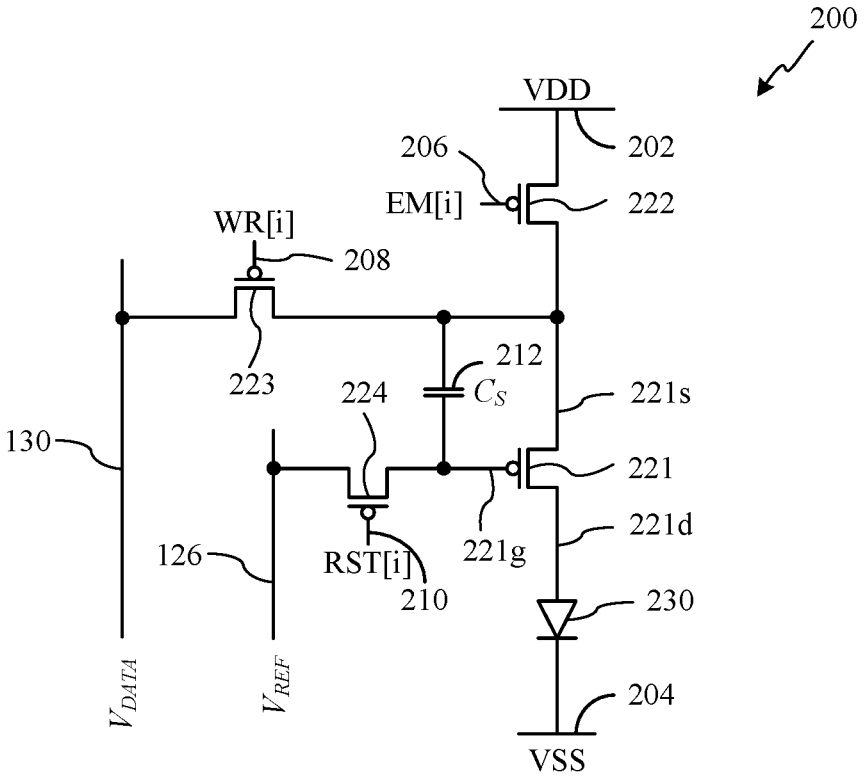
FIG. 2 is a schematic circuit diagram of an embodiment of a pixel circuit for the display of FIG. 1, the pixel circuit including four TFT transistors, an OLED, and a capacitor.

FIG. 1 is a block diagram of an exemplary OLED display system 100 according to an embodiment. The display system 100 includes a display panel 108, a source driver 110 which includes a Readout Circuit (ROC) 112, a gate driver 104, a controller 114, a memory storage 116, a reference generator 106, and a supply voltage block 102. The display panel 108 includes a plurality of pixels 200 arranged in "n" rows and "m" columns. Each pixel 200 has a pixel circuit including four Thin Film Transistors (TFTs), a storage capacitor and an OLED as shown in FIG. 2. Each pixel 200 is individually programmed to emit light with specific luminance values. The digital controller 114 receives digital video data indicative of information to be displayed on the display panel 108. The controller 114 sends signals 136 comprising digital video data to the source driver 110 and signals 134 to the gate driver 104 to drive the pixels 200 in the display panel 108 in row by row basis to display the information indicated. The plurality of pixels 200 associated with the display panel 108 thus comprise a display array ("display screen") adapted to dynamically display information according to the input digital data received by the controller 114. The display screen 108 can display, for example, video information from a stream of video data (not shown) received by the controller 114. The supply voltage block 102 provides a constant or an adjustable supply for the display panel 108 which is controlled by the signals 132 from the controller 114. The reference generator block 106 provides constant or adjustable reference voltages for the display panel 108 which is controlled by the signals 140 from the controller 114.

FIG. 1 is illustrated with only two pixels 200*a* and 200*b* in the display panel 108 for sake of simplicity and illustrative purposes. The display system 100 can be implemented with a plurality of similar pixels, such as the pixel 200 and the display panel size is not restricted to a particular number of rows and columns of pixels. For example, the display system 100 can be implemented with a display panel with a number of rows and columns of pixels commonly available in displays for mobile devices, monitor-based devices, TVs, and projection devices.

According to an embodiment, an exemplary pixel circuit 200 of a display system of FIG. 1, is shown in FIG. 2, the pixel circuit comprising four p-type TFTs (221, 222, 223 and 224), a storage capacitor ($C_s$) 212, an OLED device 230, and input with three control signals. A drive transistor 221 is coupled in series with the OLED 230, and the storage capacitor 212 is coupled across a source and a gate of the drive transistor 221. Transistor 222, controlled by EM[i], is coupled between the source of the drive transistor 221 and VDD, transistor 223 controlled by WR[i] is coupled between the source of the drive transistor 221 and the data line 130, while transistor 224 controlled by RST[i] is coupled between the gate of the drive transistor 221 and the reference line 126. Control signals EM[i] 206, WR[i] 208 and RST[i] 210 are control signals of the ith row, and are the emission, write, and reset signal respectively for the pixel circuit 200. All the control signals are provided by the gate driver block 104, as controlled by controller 114, as shown in FIG. 1. The reference voltage $V_{REF}$ is common for all pixels located in each row. These reference voltages $V_{REF}$[i] and $V_{REF}$[n] are provided over reference lines 126*i* and 126*n* by the reference voltage generator 106. The pixel circuit 200 includes a storage capacitor $C_s$ 212, for storing the data voltage $V_{DATA}$ provided by the source driver 110 over the data line 130 and for allowing the pixel circuit 200 to drive the OLED device 230 after being addressed. As such, the display panel 108 including a pixel circuit 200, is an active matrix display array. The transistors that have been utilized in the pixel circuit 200 are p-type Thin Film Transistors (TFTs), but implementations of the present disclosure are not limited to pixel circuits having a particular polarity of transistor or only to pixel circuits having thin-film transistors.

FIG. 1 is illustrated with only two pixels 200*a* and 200*b* in the display panel 108. As shown in FIG. 1, the pixel 200*a* illustrated as the top-left pixel in the display panel 108 represents a "ith" row and "jth" column, is coupled to an emission signal line 120*i* for an emission signal EM[i], a write signal line 122*i* for a write signal WR[i], a reset signal line 124*i* for a reset signal RST[i], a supply line 128*j* for a supply voltage VDD[j], a data line 130*j* for a data voltage $V_{DATA}$[j], and a reference line 126*i* for a reference voltage $V_{REF}$[i].

As shown in FIG. 1, the pixel 200*b* illustrated as the bottom-right pixel 200 in the display panel 108 represents a "nth" row and "mth" column, is coupled to an emission signal line 120*n* for an emission signal EM[n], a write signal line 122*n* for a write signal WR[n], a reset signal line 124*n* for a reset signal RST[n], a supply line 128*m* for a supply voltage VDD[m], a data line 130*m* for a data voltage $V_{DATA}$[m], and a reference line 126*n* for a reference voltage $V_{REF}$[n].

As shown in FIG. 1, the gate driver 104 provides the EM, WR, and RST signals for the emission signal lines 120*i*, 120*n*, the write signal lines 122*i*, 122*n*, and the reset signal lines 124*i*, 124*n*. These signals are utilized to control the pixels 200 in the display panel 108 in order to program the pixels 200 or to measure the pixel or OLED currents through the use of the data lines (130*j*, 130*m*). The data line 130 conveys programming information such as a programming voltage or a programming current to the pixel 200 from the source driver 110 to the pixel 200 in order to program the pixel 200 to emit a desired amount of luminance according to the digital data received by the controller 114. The programming voltage or current can be applied to the pixel 200 during a programming operation of the pixel 200 so as to charge a storage device within the pixel 200, such as a storage capacitor, thereby enabling the pixel 200 to emit light with the desired amount of luminance during an emission operation following the programming operation. For example, the storage device in the pixel 200 can be charged during a programming operation to keep the data voltage and then apply it to one or more of a gate or a source terminal of the driving transistor during the emission operation, thereby causing the driving transistor to convey the driving current through the OLED according to the voltage stored on the storage device.

Generally, in the pixel 200, the driving current that is conveyed through the light emitting device by the driving transistor during the emission operation of the pixel 200 is a current that is supplied by the supply line (e.g. the supply line 128*j* and 128*m*). The supply line 128 can provide a positive supply voltage 202 (e.g., the voltage commonly referred to in circuit design as "VDD"). In some implementations, a negative or zero (0V) supply voltage VSS 204 can be provided over a second supply line to the pixel 200. For example, each pixel can be coupled to a first supply line 128 and a second supply line (not shown) coupled with VSS, and the pixel circuits 200 can be situated between the first and second supply lines to facilitate driving current between the two supply lines during emission or other states of the pixel circuit.

In some embodiments, the display system 100 also includes a Readout Circuit (ROC) 112 which is integrated with the source driver 110. The data line (130*j*, 130*m*) connects the pixel 200 to the readout circuit 112. The data line (130*j*, 130*m*) allows the readout circuit 112 to measure a current associated with the pixel 200 and thereby extract information indicative of a degradation of the pixel 200. The Readout circuit 112 converts the associated current into a corresponding voltage. In some embodiments, this voltage is converted into a 10 to 16 bit digital code and is sent to the digital control 114 for further processing or compensation.

In some embodiments, there are three modes of operations for the display system including a drive mode, a pixel measurement mode, and an OLED measurement mode.

Drive Mode

Figure 3:
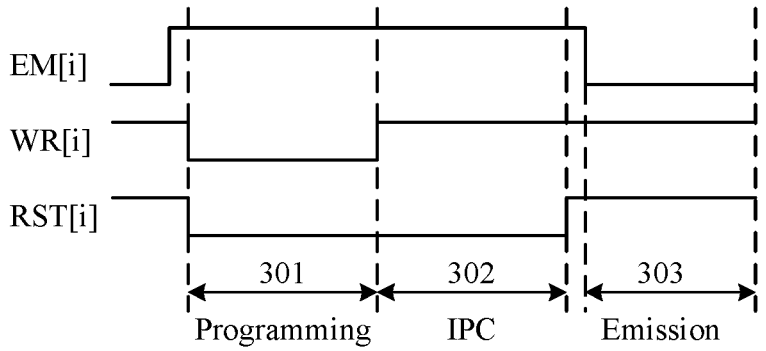
FIG. 3 is an example timing diagram of control signals of the pixel circuit in a drive mode.

A timing diagram for the control signals of the pixel circuit 200 in the drive mode is shown in FIG. 3. The timing diagram shown in FIG. 3 comprises three states which include, programming the pixel during a programming state 301, an In-Pixel Compensation state (IPC) state 302, and an emission state 303 during which the pixel emits light. During the programming state 301, the storage capacitor $C_s$ 212 is first charged to $V_{DATA}-V_{REF}$, which is the difference between the voltage of the data line 130 and the voltage of the reference line 126. During the In-Pixel Compensation (IPC) state 302 the voltage stored on the capacitor 212 changes by $\Delta V_{IPC}$. During the emission state 303, the drive transistor 221 drives the OLED device 230 with a current corresponding to the stored data voltage causing it to emit light.

Figure 6:
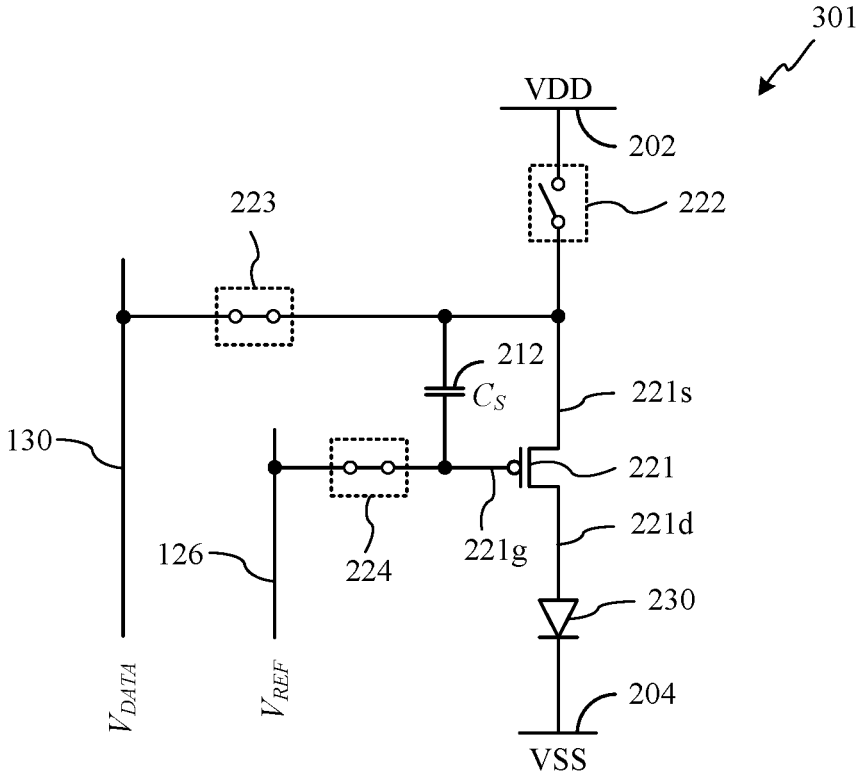
FIG. 6 is a schematic block diagram of the pixel circuit in a programming state of the drive mode.

During the programming state 301 as shown in FIG. 6, the emission signal EM[i] 206 is set to VDD, i.e. EM[i]=VDD. This turns off the transistor 222. The write signal WR[i] 208 and the reset signal RST[i] 210 are set to zero, i.e. WR[i]=0 and RST[i]=0. These signals turn on the transistors 223 and 224 and connect the node 221*g* (common with the gate of the drive transistor 221) to $V_{REF}$ and the node 221*s* (common with the source of the drive transistor 221) to $V_{DATA}$. The storage capacitor $C_s$ 212 is charged to $V_{DATA}-V_{REF}$ which is the difference between the voltage on the data line 130 and the voltage on the reference line 126. At the end of the programming state 301, the voltage stored in the storage capacitor $C_s$ 212 is equal to:

$$V_{C_s}=V_{DATA}-V_{REF} \tag{1}$$

Figure 7:
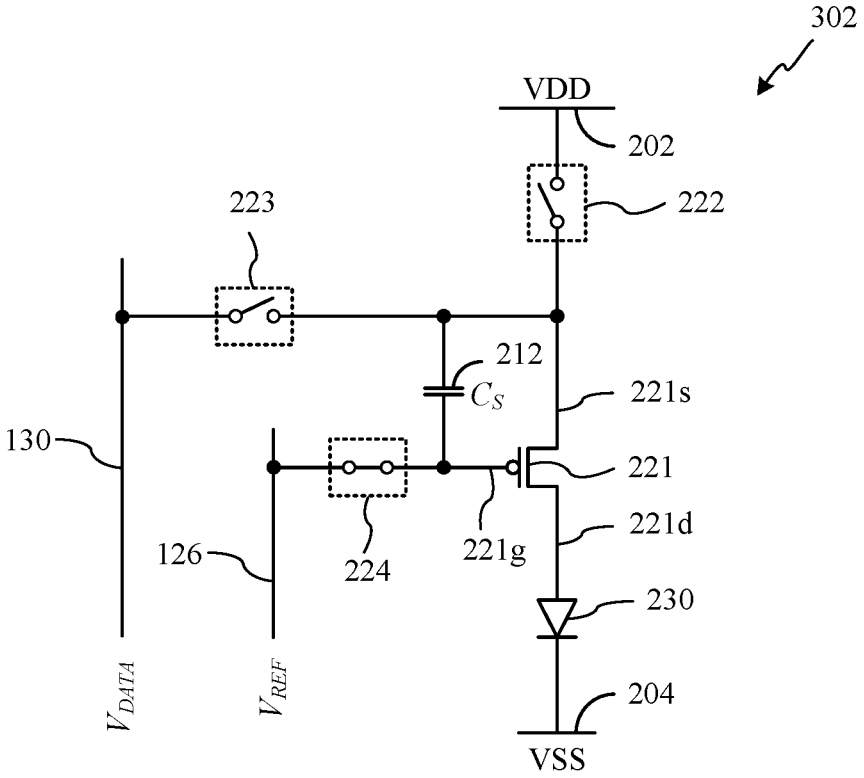
FIG. 7 is a schematic block diagram of the pixel circuit in an In-Pixel Compensation (IPC) state of the drive mode.

During the In-Pixel Compensation (IPC) state 302 as shown in FIG. 7, the emission signal EM[i] 206 and the write signal WR[i] 208 are set to VDD, i.e. EM[i]=VDD and WR[i]=VDD. These signals turn off the transistors 222 and 223. The node 221*s* is disconnected from the data line 130. The reset signal RST[i] 210 is set to zero, i.e. RST[i]=0. This turns on the transistor 224. The drive transistor 221 is turned on and IPC is performed in this state. At the end of this state, the voltage stored in the storage capacitor $C_s$ 212 is equal to:

$$V_{C_s}=V_{DATA}-V_{REF}-\Delta V_{IPC} \tag{2}$$

where $\Delta V_{IPC}$ is the voltage drop during this state.

Figure 8:
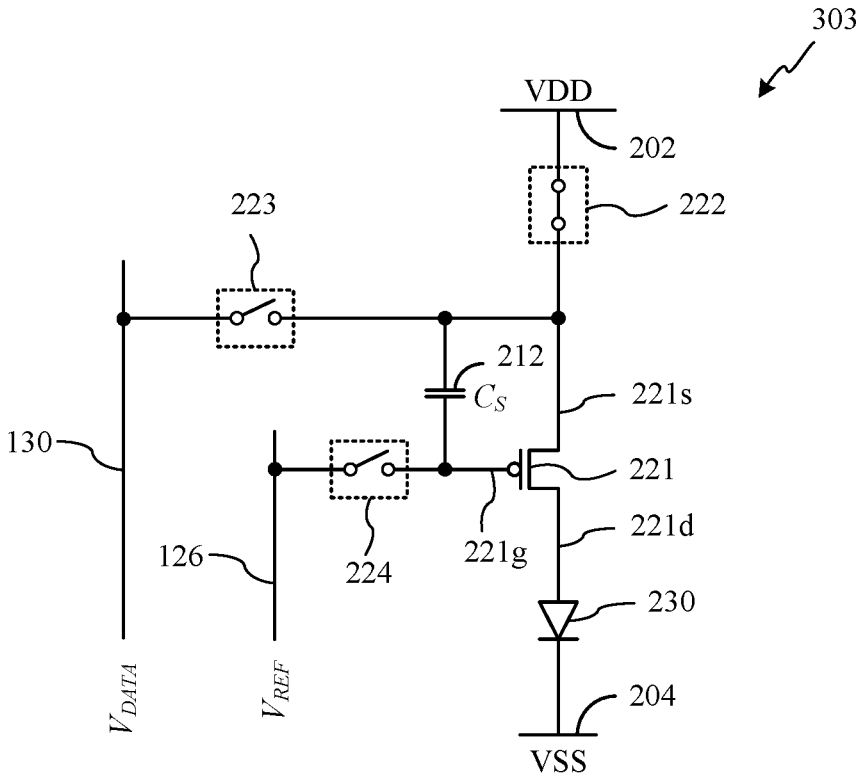
FIG. 8 is a schematic block diagram of the pixel circuit in an emission state of the drive mode.

During the emission state 303 as shown in FIG. 8, the emission signal EM[i] 206 is set to zero, i.e. EM[i]=0 and the write signal WR[i] 208 and the reset signal RST[i] 210 are set to VDD, i.e. WR[i]=VDD and RST[i]=VDD. These signals turn on the transistor 222 and turn off the transistors 223 and 224. The drive transistor 221 drives the OLED device 230 with the pixel current $I_{pixel}$ corresponding to the voltage stored in the capacitor 212 and the characteristics of the drive transistor 221. Therefore the luminance of the OLED device 230, determined by $I_{pixel}$, is dependent upon a programming of the capacitor 212 and the characteristics of the drive transistor T1.

Pixel Measurement Mode

Figure 4:
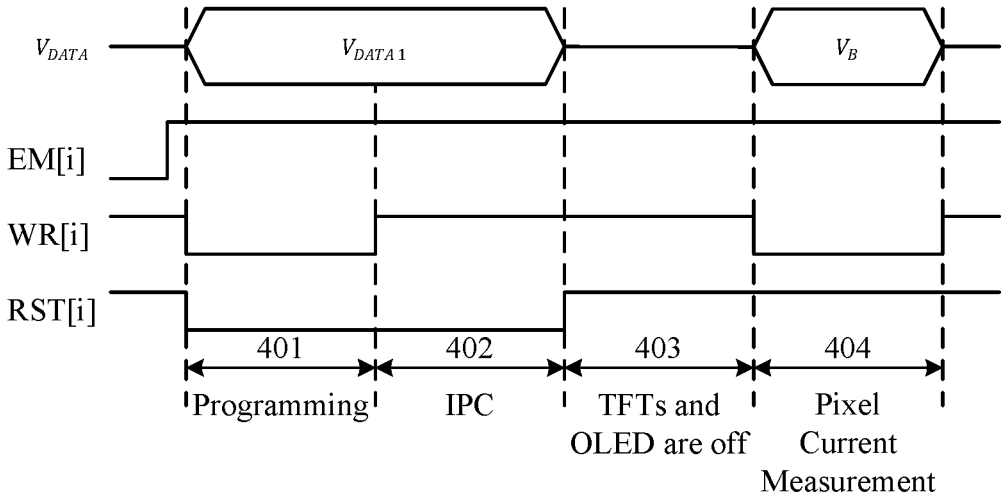
FIG. 4 is an example timing diagram of control signals of the pixel circuit in a pixel measurement mode.

The pixel current is measured in the pixel measurement mode. A timing diagram for the control signals of the pixel circuit 200 in the pixel measurement mode is shown in FIG. 4. The timing diagram shown in FIG. 4 comprises four states which include, a programming state 401, an IPC state 402, an off state 403 during which the TFTs and OLED are turned off, and a pixel current measurement state 404.

Figure 9:
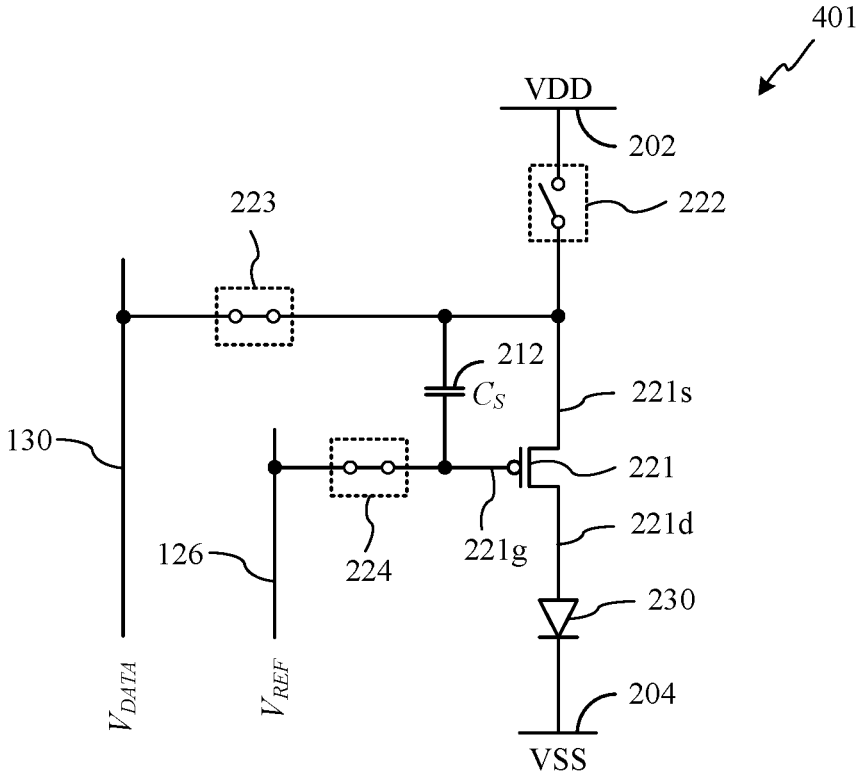
FIG. 9 is a schematic block diagram of the pixel circuit in a programming state of the pixel measurement mode.

During the programming state 401 as shown in FIG. 9, the emission signal EM[i] 206 is set to VDD, i.e. EM[i]=VDD, turning off transistor 222. The write signal WR[i] 208 and the reset signal RST[i] 210 are set to zero, i.e. WR[i]=0 and RST[i]=0. These signals turn on the transistors 223 and 224 and connect the node 221*g* to $V_{REF}$ and the node 221*s* to $V_{DATA}$. The storage capacitor $C_s$ 212 is charged to $V_{DATA}-V_{REF}$ which is the difference between the voltage on the data line 130 and the voltage on the reference line 126. At the end of this state, the voltage stored in the storage capacitor $C_s$ 212 is equal to:

$$V_{C_s}=V_{DATA}-V_{REF} \tag{3}$$

Figure 10:
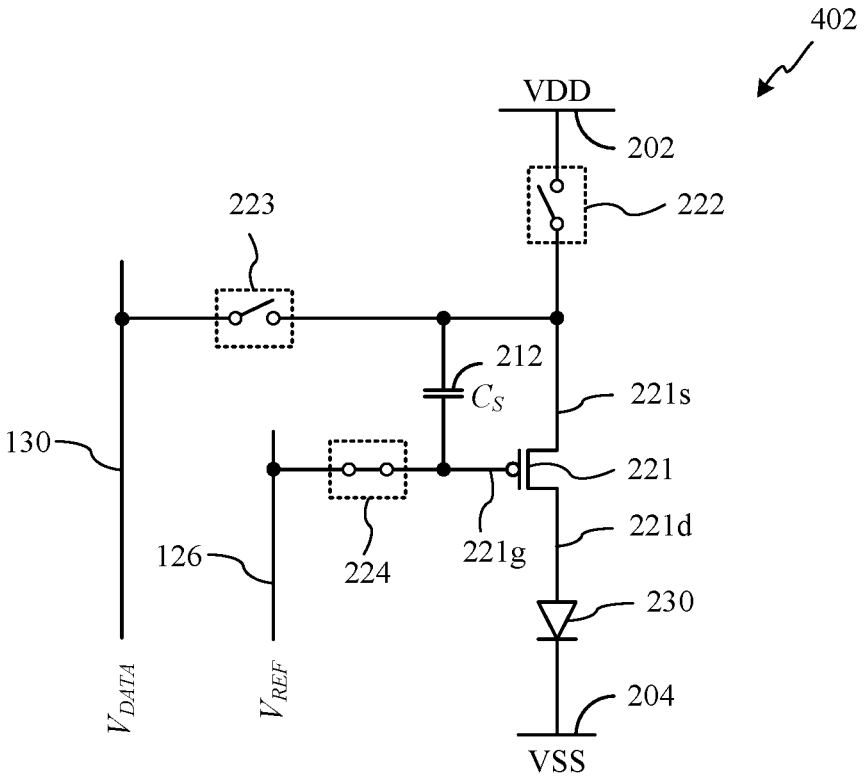
FIG. 10 is a schematic block diagram of the pixel circuit in an IPC state of the pixel measurement mode.

During the In-Pixel Compensation (IPC) state 402 as shown in FIG. 10, the emission signal EM[i] 206 and the write signal WR[i] 208 are set to VDD, i.e. EM[i]=VDD and WR[i]=VDD. These signals turn off the transistors 222 and 223. The node 221*s* is disconnected from the data line 130. The reset signal RST[i] signal 210 is set to zero, i.e. RST[i]=0. This turns on the transistor 224. The drive transistor 221 is turned on and IPC is performed in this state. At the end of this state, the voltage stored in the storage capacitor $C_s$ 212 is equal to:

$$V_{C_s}=V_{DATA}-V_{REF}-\Delta V_{IPC} \tag{4}$$

where $\Delta V_{IPC}$ is the voltage drop during this state.

Figure 11:
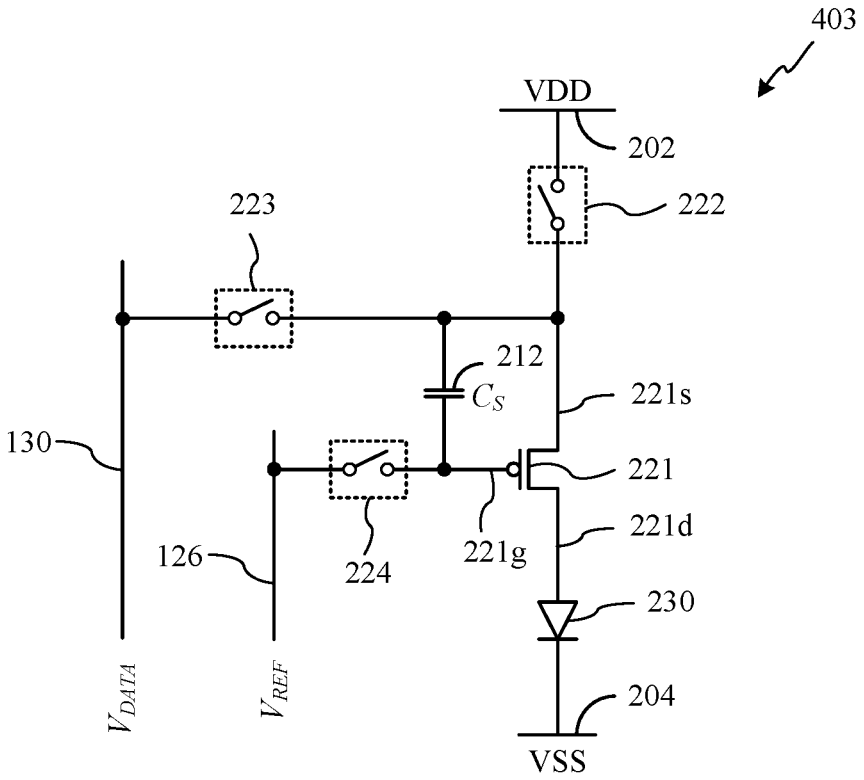
FIG. 11 is a schematic block diagram of the pixel circuit in an off state of the pixel measurement mode.

During the off state 403 as shown in FIG. 11, the emission signal EM[i] 206, the write signal WR[i] 208, and the reset signal RST[i] 210 are set to VDD, i.e. EM[i]=VDD, WR[i]=VDD and RST[i]=VDD. These signals turn off the transistors 222, 223 and 224 and disconnect the node 221*s* from the data line 130 and the node 221*g* from the reference line 126. During the off state 403, no current is passing through the OLED 230 and it is off during this state.

Figure 12:
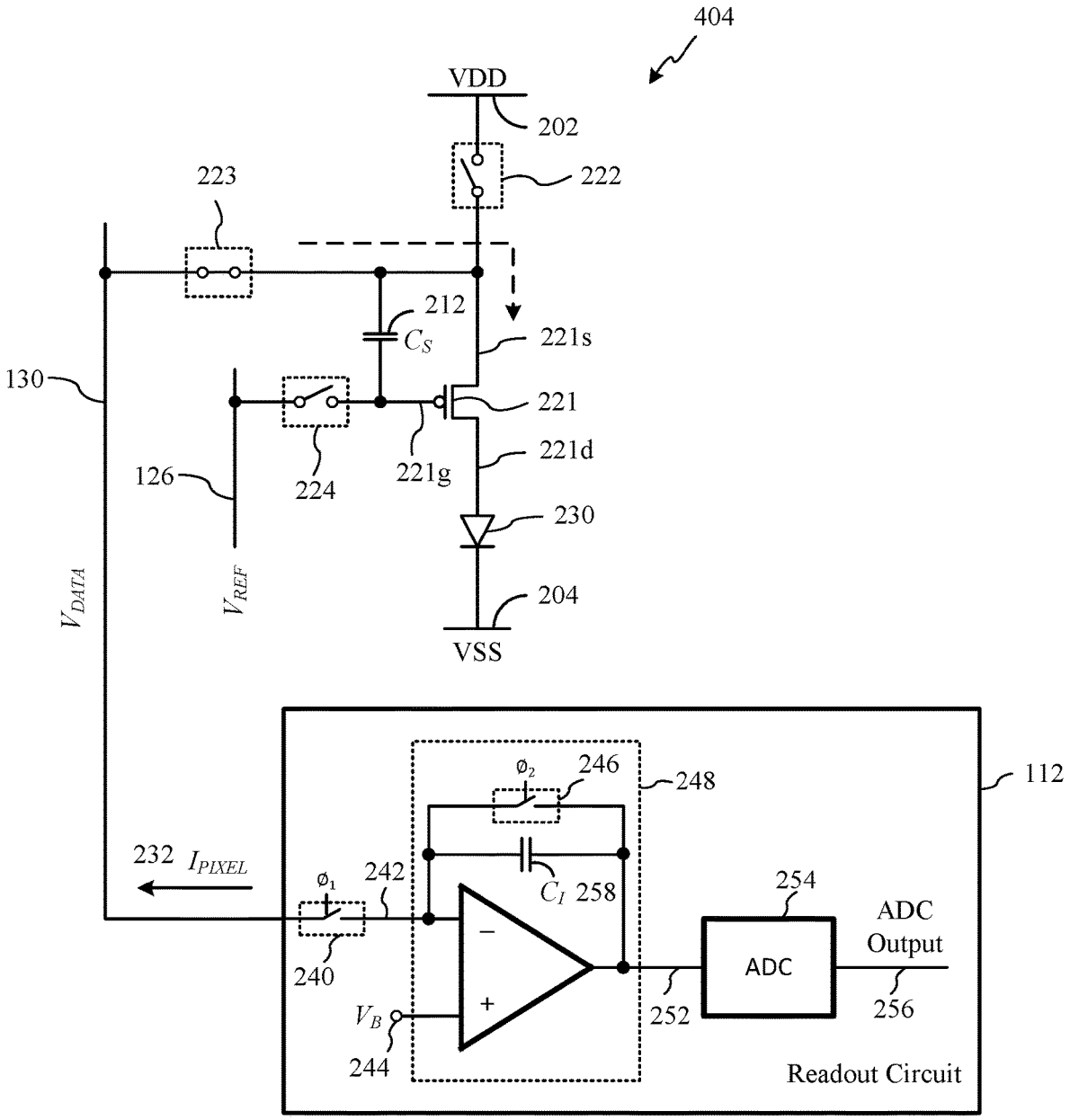
FIG. 12 is a schematic block diagram of the pixel circuit in a pixel current measurement state of the pixel measurement mode.

During the pixel current measurement state 404 as shown in FIG. 12, the emission signal EM[i] 206 and the reset signal RST[i] 210 are set to VDD, i.e. EM[i]=VDD and RST[i]=VDD. The write signal WR[i] 208 is set to zero, i.e. WR[i]=0. The write signal WR[i] 208 turns on the transistor 223 and the node 221*s* is connected to the data line 130. In this state, the data line 130 is connected to the ROC 112 to measure the pixel current $I_{Pixel}$ 232. The drive transistor 221 drives the OLED device 230 with the pixel current $I_{pixel}$ corresponding to the voltage stored in the capacitor 212 and the characteristics of the drive transistor 221. The pixel current $I_{pixel}$ 232 is measured in this state and this current is converted to a corresponding voltage 252 which is quantized to 10 to 16 bit digital code 256 by the ADC 254.

In some embodiments, in order to characterize the drive transistor 221, pixel measurement is performed more than once, utilizing different voltages to program the capacitor 212. In some embodiments, two points of an I-V curve for the drive transistor 221 are extracted using two different programming voltages for the capacitor and measuring the resulting two different pixel currents $I_{pixel}$, and the rest of the I-V curve is extrapolated with use of those two points.

OLED Measurement Mode

Figure 5:
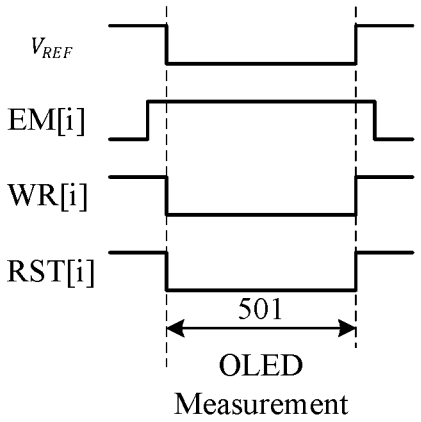
FIG. 5 is an example timing diagram of control signals of the pixel circuit in an OLED measurement mode.

In this mode, in order to determine the I-V characteristic of the OLED device which is utilized to compensate aging of the OLED, the OLED current is measured. A timing diagram for the control signals of the pixel circuit 200 in the OLED measurement mode is shown in FIG. 5. The timing diagram shown in FIG. 5 comprises only one state which is the OLED measurement state 501.

Figure 13:
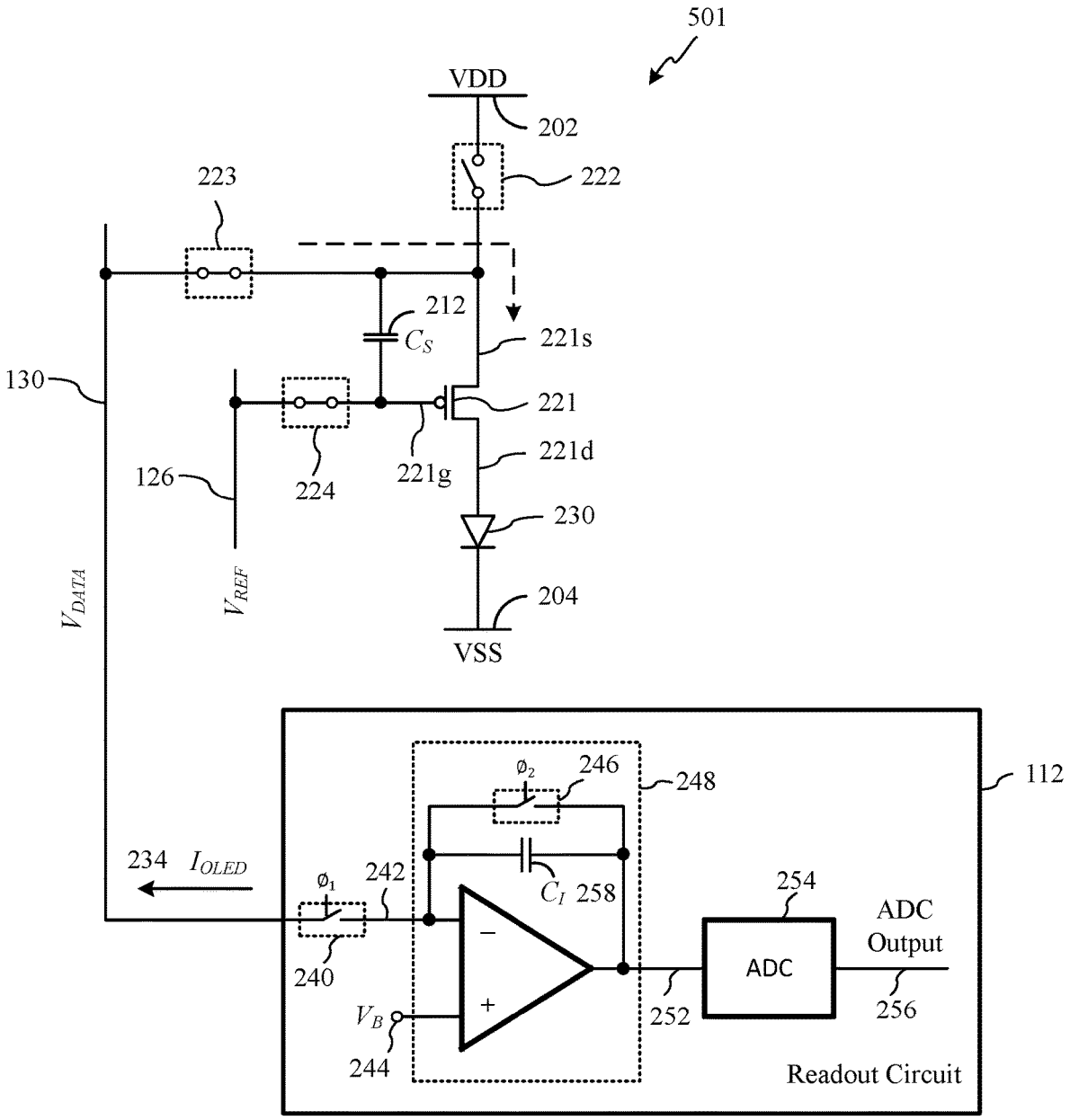
FIG. 13 is a schematic block diagram of the pixel circuit in the OLED measurement mode.

During the OLED measurement state 501 as shown in FIG. 13, the emission signal EM[i] 206 is set to VDD, i.e. EM[i]=VDD and the write signal WR[i] 208 and the reset signal RST[i] 210 are set to zero, i.e. WR[i]=0 and RST[i]=0. The write signal WR[i] 208 turns on the transistor 223 and the node 221*s* is connected to the data line 130. In this state, the reference voltage $V_{REF}$ of the reference line 126 is switched to the lowest voltage, i.e. $V_{REF}=0$. The reset signal RST[i] 210 turns on the transistor 224 therefore the node 221*g* is connected to the reference line 126 which has a reference voltage $V_{REF}$ set to zero. The data voltage $V_{DATA}$ is set to a voltage greater than zero such that the drive transistor 221 is turned on in this state and behaves like a closed switch. Since the drive transistor 221 behaves as a switch, the data voltage $V_{DATA}$ is provided to the node 221*d*, and is also set to a voltage great enough ($V_{DATA}>V_{OLED}$) such that the OLED 230 turns on. In this state 501, the data line 130 is connected to the Readout Circuit (ROC) 112 to measure the OLED current $I_{Oled}$ 234. The OLED current $I_{Oled}$ 234 is measured in this mode and is converted to a corresponding voltage 252 which is quantized to 10 to 16 bit digital code 256 by an Analog-To-Digital Converter (ADC) 254.

In some embodiments, in order to characterize the I-V characteristic of the OLED 230, the OLED measurement is conducted more than once, utilizing different data voltages $V_{DATA}$ each sufficient to turn on the drive transistor 221 as a switch and great enough ($V_{DATA}>V_{OLED}$) to turn on the OLED 230, with whatever voltage spacing is desired to create an I-V characteristic curve of a desired resolution.

The ROC 112 as shown in FIG. 12 and FIG. 13 includes an integrator 248, an analog to digital converter (ADC) 254, and one switch 240 coupling the coupling the ROC 112 to the data line 130 at the integrator 248. The integrator 248 includes a reset switch 246 and an integrating capacitor $C_I$ 258 in parallel and connected between a first input 242 and an output of the integrator 248 and a bias voltage $V_B$ coupled to a second input 244 of the integrator 248. During measurement, the switch 130 is closed and the integrator 246 integrates the current coming from pixel 200 ($I_{pixel}$ 232 or $I_{oled}$ 234) and converts it to a corresponding voltage 252. The output voltage of the integrator 252 is applied to the ADC 254 and this voltage is converted to 10 to 16 bit digital code 256 by the ADC 254.

Although the embodiments have been described with functionality of the transistors resulting from the application of particular example voltage values such as "VDD" or "0" or "VSS", it is to be understood that in different contexts, the application of "high" and "low" voltages of appropriate different voltage values may be used to effect the same functionality from transistors and do not represent a departure from the embodiments disclosed above.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A display system comprising:

an array of pixel circuits arranged in rows and columns, a pixel circuit of the array of pixel circuits including:

a drive transistor including a first terminal coupleable to a data line of the display system;

a storage capacitor coupleable across a gate terminal and the first terminal of the drive transistor;

a light emitting device coupleable to a second terminal of the drive transistor different from the first terminal; and a first transistor other than the drive transistor, for decoupling a supply voltage from a conductive path carrying a current passing through the drive transistor, the light emitting device, and the data line during a measurement state, and a controller for driving the pixel circuit in a plurality of operation states for the pixel circuit including a programming state for programming the storage capacitor of the pixel circuit with use of a data voltage provided over the data line, and the measurement state for measuring the current passing through the drive transistor, the light emitting device, and the data line, the controller turning off the first transistor during the measurement state to decouple the supply voltage from the conductive path carrying the current passing through the drive transistor, the light emitting device, and the data line, during the measurement state.

2. The display system of claim 1, further comprising a readout circuit coupleable to the data line for measuring the current from the pixel circuit over the data line.

3. The display system of claim 2 wherein the readout circuit comprises an integrator for integrating said current from the pixel during said measuring and generating an output voltage corresponding to said integrated current, and an analog to digital converter for converting said output voltage into a digital code output.

4. The display system of claim 2, wherein the readout circuit is not coupleable to the pixel circuit via a signal line different from the data line for measuring the current from the pixel circuit.

5. The display system of claim 1, wherein the measurement state for measuring a current from the pixel circuit comprises an organic light emitting diode (OLED) measurement state for measuring an OLED current from the pixel circuit passing through said light emitting device.

6. The display system of claim 5, wherein the pixel circuit further comprises a reference line coupleable to a gate terminal of the drive transistor, and wherein the controller, during the OLED measurement state, couples the gate terminal of the drive transistor to the reference line and provides a reference voltage over the reference line sufficient to turn on the drive transistor such that it acts as a closed switch, couples the first terminal of the drive transistor to the data line and provides a data voltage over the data line sufficient to turn on the light emitting device.

7. The display system of claim 6 further comprising a readout circuit coupleable to the data line for measuring the current from the pixel circuit over the data line, the readout circuit comprising an integrator for integrating said OLED current from the pixel during said measuring and generating a corresponding output voltage, and an analog to digital converter for converting said output voltage into a digital code output, wherein the controller couples the gate terminal of the drive transistor to the reference line with use of a second transistor in the pixel circuit, and couples the first terminal of the drive transistor to the data line with use of a third transistor coupled between the first terminal and the data line.

8. The display system of claim 1, wherein the measurement state for measuring a current from the pixel circuit comprises a pixel circuit measurement state for measuring a pixel circuit current from the pixel circuit passing through said drive transistor according to the voltage difference across the storage capacitor, said pixel circuit measurement state subsequent to the programming state.

9. The display system of claim 8, wherein the pixel circuit further comprises a reference line coupleable to a gate terminal of the drive transistor, wherein the controller, during the pixel circuit measurement state, decouples the reference line from the gate terminal of the drive transistor to maintain the voltage difference across the storage capacitor, and couples the first terminal of the drive transistor to the data line.

10. The display system of claim 9 further comprising a readout circuit coupleable to the data line for measuring the current from the pixel circuit over the data line, the readout circuit comprising an integrator for integrating said pixel circuit current from the pixel circuit during said measuring and generating a corresponding output voltage and an analog to digital converter for converting said output voltage into a digital code output, and wherein the controller during the pixel circuit measurement state, decouples the reference line from the gate terminal with use of a second transistor coupled between the gate terminal of the drive transistor and the reference line, and couples the first terminal of the drive transistor to the data line with use of a third transistor coupled between the first terminal and the data line.

11. The display system of claim 1, wherein the pixel circuit comprises transistors which are only p-type thin film transistors (TFTs), and wherein said light emitting device is an OLED.

12. A method of driving a display system, the display system including an array of pixel circuits arranged in rows and columns, a pixel circuit of the array of pixel circuits including: a drive transistor including a first terminal coupleable to a data line of the display system; a storage capacitor coupleable across a gate terminal and the first terminal of the drive transistor; a light emitting device coupleable to a second terminal of the drive transistor different from the first terminal; and a first transistor other than the drive transistor, for decoupling a supply voltage from a conductive path carrying a current passing through the drive transistor, the light emitting device, and the data line during a measurement state, the method comprising:

driving the pixel circuit in a plurality of operation states for the pixel circuit including:

during a programming state, programming the storage capacitor of the pixel circuit with use of a data voltage provided over the data line, and during the measurement state, measuring the current passing through the drive transistor, the light emitting device, and the data line and turning off the first transistor to decouple the supply voltage from the conductive path carrying the current passing through the drive transistor, the light emitting device, and the data line, during the measurement state.

13. The method of claim 12, wherein measuring the current from the pixel circuit comprises coupling a readout circuit to the data line and measuring said current from the pixel circuit with use of said readout circuit.

14. The method of claim 13 wherein measuring said current from the pixel circuit with use of said readout circuit comprises integrating said current from the pixel circuit, generating a corresponding output voltage, and converting said output voltage into a digital code output.

15. The method of claim 13, wherein the readout circuit is not coupleable to the pixel circuit via a signal line different from the data line for measuring the current from the pixel circuit.

16. The method of claim 12, wherein measuring the current from the pixel circuit comprises measuring an OLED current from the pixel circuit passing through said light emitting device during an OLED measurement state.

17. The method of claim 16, wherein the pixel circuit further comprises a reference line coupleable to a gate terminal of the drive transistor, and wherein measuring the OLED current during the OLED measurement state comprises, coupling the gate terminal of the drive transistor to the reference line, providing a reference voltage over the reference line sufficient to turn on the drive transistor such that it acts as a closed switch, coupling the first terminal of the drive transistor to the data line, and providing a data voltage over the data line sufficient to turn on the light emitting device.

18. The method of claim 17 wherein measuring the OLED current during the OLED measurement state comprises:

coupling the gate terminal of the drive transistor to the reference line with use of a second transistor in the pixel circuit;

coupling the first terminal of the drive transistor to the data line with use of a third transistor coupled between the first terminal and the data line; and coupling a readout circuit to the data line and measuring said current from the pixel circuit with use of said readout circuit, including, integrating said OLED current from the pixel circuit, generating an output voltage corresponding to the integrated current, and converting said output voltage into a digital code output.

19. The method of claim 12, wherein measuring said current from the pixel circuit comprises measuring a pixel circuit current from the pixel circuit passing through said drive transistor according to the voltage difference across the storage capacitor, during a pixel circuit measurement state subsequent to the programming state.

20. The method of claim 19, wherein measuring the pixel current during the pixel circuit measurement state comprises decoupling the reference line from the gate terminal of the drive transistor to maintain the voltage difference across the storage capacitor and coupling the first terminal of the drive transistor to the data line.

21. The method of claim 20 wherein measuring the pixel circuit current during the pixel circuit measurement state comprises:

decoupling a reference line from the gate terminal of the drive transistor with use of a second transistor coupled between the gate terminal of the drive transistor and the reference line;

coupling the first terminal of the drive transistor to the data line with use of a third transistor coupled between the first terminal and the data line; and coupling a readout circuit to the data line and measuring said current from the pixel circuit with use of said readout circuit, including, integrating said pixel circuit current from the pixel circuit, generating an output voltage corresponding to the integrated current, and converting said output voltage into a digital code output.

22. The method of claim 12, wherein the pixel circuit comprises transistors which are only p-type TFTs, and wherein said light emitting device is an OLED.

* * * * *